United States Patent [19]

Neumann et al.

[11] Patent Number: 4,614,029

[45] Date of Patent: Sep. 30, 1986

[54] METHOD OF MANUFACTURING CONTACT SPRING SOCKETS

[75] Inventors: Gerhard Neumann, Waldkraiburg; Hans Ramisch, Mühldorf, both of Fed. Rep. of Germany

[73] Assignee: Otto Dunkel GmbH Fabrik fur Elektrontechnische Gerate, Muhldorf am Inn, Fed. Rep. of Germany

[21] Appl. No.: 718,446

[22] Filed: Apr. 1, 1985

[30] Foreign Application Priority Data

Apr. 5, 1984 [DE] Fed. Rep. of Germany ..... 3412877

[51] Int. Cl.[4] ..... H01R 43/04

[52] U.S. Cl. ..... 29/882; 29/511; 29/874; 339/256 S

[58] Field of Search ..... 29/874, 876, 882, 446, 29/511, 525; 339/256 R, 256 RT, 256 S, 256 T, 262 R

[56] References Cited

U.S. PATENT DOCUMENTS 4,572,606 2/1986 Neumann et al. ..... 339/262 R

FOREIGN PATENT DOCUMENTS 1082957 6/1960 Fed. Rep. of Germany .
1263893 3/1968 Fed. Rep. of Germany .
340878 10/1959 Switzerland .

*Primary Examiner*—Howard N. Goldberg
*Assistant Examiner*—Carl J. Arbes
*Attorney, Agent, or Firm*—Holman & Stern

[57] ABSTRACT

The method relates to manufacturing contact spring sockets with a plurality of radially inward bowed contact springs (9) clamped at one end in an approximately cylindrical socket body (1), formed by a thin-walled deformable sleeve. The straight contact springs, formed by sections of a contact spring wire, are introduced into the socket body and made fast at their front ends to a central head (10) at the front end of a line connector (2) by deformation of the socket material. The free ends of the contact springs (9) are brought into supporting abutment on an annulus (5) at the pin insertion end. Deformation of the socket body (1) to produce bowing of the contact springs can be omitted if in accordance with the invention an insert ring (6) is introduced into the middle region of the socket body (1), which fits adjacent the interior wall of the socket, subsequently the contact springs (9) are introduced into the socket body, whereby they lie adjacent the insert ring (6), and following on this a mandrel (12), which is conically shaped and whose diameter increases towards its front end, together with the annulus (5) mounted on it, is introduced into the socket body (1) and again withdrawn from the socket body with radial expansion of the annulus (5) which is secured against axial displacement during this while carrying with it the outer ends of the contact springs, and finally the central head (10) is deformed while carrying with it inner ends of the contact springs.

5 Claims, 3 Drawing Figures

METHOD OF MANUFACTURING CONTACT SPRING SOCKETS

BACKGROUND OF THE INVENTION

This invention relates to a method of manufacturing contact spring sockets with a plurality of radially inward bowed contact springs clamped at one end in an approximately cylindrical socket body, formed by a thin-walled deformable sleeve, wherein straight contact springs, formed by sections of a contact spring wire, are introduced into the socket body from one socket end, wherein the fastening in the socket body of the contact springs at their front ends in an aligned state relative to each other, to a central annular head at the front end of a line connector projecting into the socket body, is achieved by means of deformation of the socket material, and wherein the free ends of the contact springs are brought into supporting abutment on an annulus at the pin insertion end, which is associated with an assembly mandrel passing through it, which is coaxially introduced into the socket body during manufacture, and finally withdrawn from it.

A method of this type which belongs to the state of the art, according to which contact spring sockets of particularly small construction can be manufactured, is described in the Patent application P33 42 742.9-34 which is not a prior publication. This method uses sleeves with a wall thickness of 0.1 mm, economically prefabricated by drawing, which can easily be deformed from outside. After introduction of the contact springs the sockets are provided with a radially inward projecting annular indentation at each of two spaced apart regions axially offset relative to the annulus and the annular head respectively. These annular radial indentations press on the contact springs and bow them radially inward.

In this manner contact pins of only about 0.6 mm diameter can be provided with sockets with an external diameter of only about 1.5 mm. Thus an extraordinarily large number of contact spring sockets can be arranged next to each other in a very small space, and thereby high quality multicontact connectors can be produced at low cost.

In this method of manufacture the degree of deformation of the socket body determines the size of the annular indentations and thus the bowing of the contact springs, on which in turn the contact force depends.

SUMMARY OF THE INVENTION

It has been shown, that deformation of the socket body to form the annular indentations can be omitted, if in accordance with the invention the following method steps are carried out in the manufacture of the contact spring sockets:

(a) introduction into the middle region of the socket body of an insert ring fitting adjacent the interior wall of the socket and projecting with its end edges into the socket interior (b) introduction into the socket body of the contact springs, whereby they lie adjacent the insert ring and with their front edges they extend into the co-axial annular gap between the interior wall of the socket and the central head of the line connector which projects into the interior of the socket, (c) introduction into the socket body of the mandrel, which is conically shaped and whose diameter increases towards its front end, together with the annulus mounted on it, (d) withdrawal of the mandrel from the socket body with radial expansion of the annulus which is secured against axial displacement while carrying with it the outer ends of the contact springs until abutment on the interior wall of the socket and (e) deformation of the central head while carrying with it the inner ends of the contact springs, as well as (f) optionally forming a flange by folding over the outer edge of the contact socket, to secure the annulus.

Because, after these steps have been carried out, the inner end edges of the insert ring press radially inward on the contact springs, these end edges determine the elastic deformation of the contact springs. Their bowing can already be determined relatively easily prior to assembly, which facilitates precision manufacture. The latter can be done particularly swiftly, as expansion of the annular body accompanies the elastic deformation and the so created pin insertion opening in an elegant manner frees a path for a tool for deforming the central head.

It is particularly suitable for rapid deformation of the annular body if the mandrel on withdrawal from the socket body has vibrations transmitted to it to facilitate expansion of the annulus. For this reason it has proved advantageous if the conical mandrel in the region of its greatest cross-section is provided with a diameter which is somewhat smaller than the internal diameter of insert ring less twice the diameter of contact springs.

BRIEF DESCRIPTION OF THE DRAWINGS further details, advantages and features of the invention emerge from the following description and the drawing, to which express reference is made as regards all details not described in the text. There is shown in:

FIGS. 1 to 3 very schematically the method steps of the method according to the invention to produce a finished socket.

DETAILED DESCRIPTION OF THE INVENTION

Figure 3:
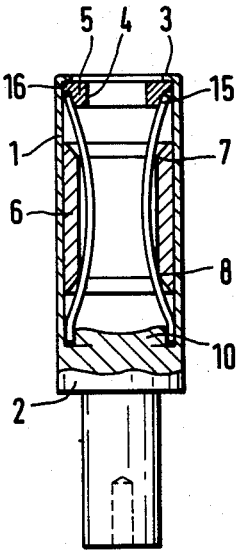

As can be seen from the drawing, the contact spring socket illustrated in FIG. 3 comprises an approximately cylindrical socket body 1 in the form of a thin-walled deformable sleeve. This socket body 1 is formed as a constructional unit with line connector 2. At the opposite end the socket body 1 has a flange 3. An annulus 5 abuts flange 3 and has a central pin insertion opening 4.

An insert ring 6 fits adjacent the interior wall of the socket body 1 in its middle region, which projects with its end edges 7 and 8 into the interior of the socket. A plurality of contact springs 9 are supported on it. These contact springs 9 are clamped at one end between a central annular head 10 of line connector 2 which projects into socket body 1 and the interior wall of the socket body 1. The other ends of the contact springs 9 which face the pin insertion end of socket body 1 are freely movable in a ring gap 11 defined between the socket body and annulus 5. The radially inward bowing of the contact springs 9 illustrated in FIG. 3 results from abutment of end edges 7 and 8 of insert ring 6, supported on the interior wall of the socket, whose internal diameter is smaller than the external diameter of annulus 5 after expansion. On these two end edges 7 and 8 which are axially offset relative to annulus 5 and central head 10 respectively contact springs 9 abut. They deform them elastically radially inward.

As can be seen from FIG. 3, in the finished contact spring socket the internal diameter of annulus 5 is smaller than the smallest mutual spacing of those bowed contact springs 9 which lie in any one plane passing through the axis of the socket. By reason of the above mentioned dimensional relationships perfect mutual contact is guaranteed, even if a contact pin should be inserted into the contact spring socket with its axis slightly offset. The contact springs 9 are then able to accommodate the eccentric position of the contact pin by reason of the displaceability of their contact spring ends.

The drawing schematically illustrates the steps used in the manufacturing method of the invention. Firstly the socket body 1 is placed ready, after which the insert ring 6 is inserted until it is in the middle region of the socket body.

In a further step the contact springs 9 are introduced into the socket body 1 by means of delivery apparatus not shown in detail. With their front edges they come to lie in the annular space between the socket wall and central head 10. Thereby they are positioned adjacent insert ring 6 aligned substantially parallel.

Figure 1:
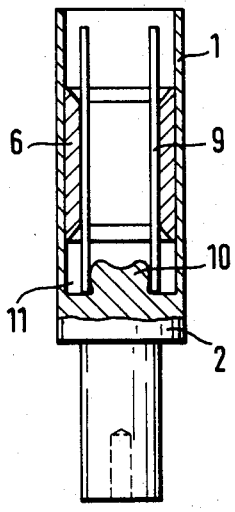
Figure 2:
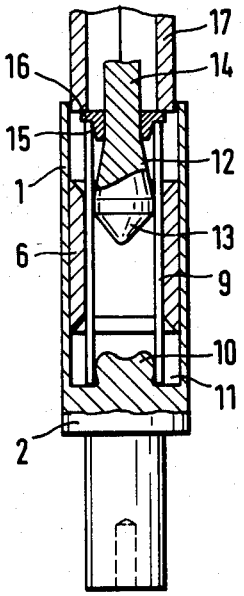

As is shown in FIG. 2, in a further step an assembly mandrel 12 together with the annulus mounted on it are introduced into the socket body 1, namely into the central region between the contact spring ends. To facilitate this introduction the mandrel 12 has a conically pointed front end. A conically shaped portion of reducing diameter forms the main part of the mandrel 12 and abuts the region of largest cross-section which has a diameter which is somewhat smaller than the internal diameter of the insert ring less twice the diameter of the contact springs. Approximately at the transition point to cylindrical shaft 14 of the mandrel 12 there is supported annulus 5, which at this stage of the method still has an internal diameter which is hardly larger than the external diameter of shaft 14. Annulus 5 has a conical section 15 which facilitates abutment of the contact spring ends in the position shown in FIG. 2. With its flange 16 which radially extends beyond the contact spring ends, annulus 5 comes to lie below a device associated with mandrel 12, which serves to secure annulus 5 against axial displacement when the mandrel is withdrawn in an axial direction from socket body 1. This device comprises a hollow cylinder 17 split in a longitudinal direction whose front edges come into abutment on the annulus. These two halves of the hollow cylinder are mounted to be displaceable relative to each other in a radial direction, in order after introduction of the mandrel 12 into the socket body 1 to be able to check and cover annulus 5, before the mandrel 12 is again withdrawn.

Annulus 5 is made of soft copper and is thus correspondingly easily deformable and during this it is slowly expanded. This can be facilitated by transmitting vibrations. Annulus 5 finally with its flange 16 comes into abutment with the socket wall wwhile carrying with it the ends of socket springs 9. The annulus has now experienced its maximum expansion and has a central pin insertion opening 4 with a diameter, which corresponds to the largest diameter of mandrel 12.

Following on this the outer edge of the socket can be provided with flange 3 for further securing the annulus 5.

Through the pin entry opening 4, the central head 10 of the line connector is now so radially deformed that the contact spring ends are carried with it and come to lie against the socket interior wall.

Finally in the finished state shown in FIG. 3 the prescribed functional tests on the contact spring sockets can be carried out.

What is claimed is

1. Method of manufacturing contact spring sockets with a plurality of radially inward bowed contact springs clamped at one end in an approximately cylindrical socket body, formed by a thin-walled deformable sleeve, wherein straight contact springs, formed by sections of a contact spring wire, are introduced into the socket body from one socket end, wherein the fastening in the socket body of the contact springs at their front ends in an aligned state relative to each other, to a central annular head at the front end of a line connector projecting into the socket body is achieved by means of deformation of the socket material, and wherein the free ends of the contact springs are brought into supporting abutment on an annulus at the pin insertion end, which is associated with an assembly mandrel passing through it, which is co-axially introduced into the socket body during manufacture, and finally withdrawn from it, characterized by the following method steps:

(a) introduction into the middle region of the socket body (1) of an insert ring fitting adjacent the interior wall of the socket and projecting with its end edges into the socket interior (b) introduction into the socket body of the contact springs, whereby they lie adjacent the insert ring and with their front edges they extend into the co-axial annular gap between the interior wall of the socket and the central head of the line connector which projects into the interior of the socket, (c) introduction into the socket body of the mandrel, which is conically shaped and whose diameter increases towards its front end, together with the annulus mounted on it, (d) withdrawal of the mandrel from the socket body with radial expansion of the annulus which is secured against axial displacement while carrying with it the outer ends of the contact springs until abutment on the interior wall of the socket and (e) deformation of the central head while carrying with it the inner ends of the contact springs, as well as (f) optionally forming a flange by folding over the outer edge of the contact socket, to secure the annulus.

2. Method according to claim 1, characterized in that, the mandrel on withdrawal from the socket body has vibrations transmitted to it to facilitate expansion of the annulus (5).

3. Method according to claim 1, characterized in that, the conical mandrel in the region of its greatest cross-section is provided with a diameter which is somewhat smaller than the internal diameter of insert ring less twice the diameter of contact springs.

4. Method according to claim 3, characterized in that, the largest diameter of the mandrel is chosen to be equal to the diameter of the central pin insertion opening of the annulus after it has been expanded.

5. Method according to claim 1, characterized in that, after introduction of the mandrel with the annulus into the socket body a hollow cylinder is used to secure the annulus against axial displacement which hollow cylinder is subdivided into two radially separable halves and whose front edge comes into abutment with the annulus.

* * * * *